US005495140A

United States Patent [19]

Fujiwara et al.

[11] Patent Number: 5,495,140

[45] Date of Patent: Feb. 27, 1996

[54] CATHODE-RAY TUBE HAVING A SUBSTANTIALLY FLAT FACE PANEL

[75] Inventors: Takeshi Fujiwara, Dusseldorf, Germany; Kumio Fukuda; Shinji Ohama, both of Fukaya, Japan

[73] Assignee: Kabushiki Kaisha Toshiba, Kawasaki, Japan

[21] Appl. No.: 398,044

[22] Filed: Mar. 2, 1995

Related U.S. Application Data

[63] Continuation of Ser. No. 10,808, Jan. 29, 1993, abandoned.

[30] Foreign Application Priority Data

Jan. 31, 1992 [JP] Japan ..... 4-016931

[51] Int. Cl.[6] ..... H01J 31/00; H01J 29/86

[52] U.S. Cl. ..... 313/477 R; 313/461; 220/2.1 A

[58] Field of Search ..... 313/477 R, 461; 220/2.1 A

[56] References Cited

U.S. PATENT DOCUMENTS

| | | | |
|---|---|---|---|
| 4,535,907 | 8/1985 | Tokita et al. | 220/2.1 A |
| 4,537,321 | 8/1985 | Tokita | 220/2.1 A |
| 4,537,322 | 8/1985 | Okada et al. | 220/2.1 A |
| 4,570,101 | 2/1986 | Campbell | 313/461 |
| 4,580,077 | 4/1986 | Bakker et al. | 313/477 R |
| 4,786,840 | 11/1988 | Ragland, Jr. | 313/477 R |
| 5,107,999 | 4/1992 | Canevazzi | 313/477 R |
| 5,155,410 | 12/1992 | Wakasono et al. | 313/477 R |

FOREIGN PATENT DOCUMENTS

| | | |
|---|---|---|
| 0283129 | 9/1988 | European Pat. Off. . |
| 0448401 | 9/1991 | European Pat. Off. . |
| 3272550 | 12/1991 | Japan . |

*Primary Examiner*—Sandra L. O'Shea
*Assistant Examiner*—Vip Patel
*Attorney, Agent, or Firm*—Cushman Darby & Cushman

[57] ABSTRACT

The present invention relates to a cathode-ray tube having: (1) a face panel; (2) a phosphor screen; (3) a funnel coupled to the face panel; and (4) an electron beam emitter. The outer surface of the face panel is defined by using orthogonal coordinates. An origin of the orthogonal coordinates is defined as a center of the outer surface of the face panel. An X-axis of the orthogonal coordinates is defined as a horizontal axis. A Y-axis of the orthogonal coordinates is defined as a vertical axis. A Z-axis of the orthogonal coordinates is defined as the central axis of the funnel. The Z coordinate for points on the outer surface of the face panel are defined by the polynomial:

$$Z=\sum_{i=0}^{n}\sum_{j=0}^{n} a_{ij}x^{2i}y^{2j};$$

wherein i and j are integers $\geqq 0$, n=2, and aij are predetermined coefficients of the polynomial. The predetermined coefficients along the X-axis are represented by $a_{10}$ and $a_{20}$, and coefficients along the Y-axis are represented by $a_{01}$ and $a_{02}$. The coefficients $a_{10}$, $a_{20}$, $a_{01}$, and $a_{02}$ satisfy the relationships: (1) $a_{20}/a_{10}<0.1\times10^{-6}$; and (2) $a_{02}/a_{01}<0.1\times10^{-6}$. The remaining coefficients are selected so that an external light image is not distorted when reflected from the outer surface of the face panel.

1 Claim, 2 Drawing Sheets

CATHODE-RAY TUBE HAVING A SUBSTANTIALLY FLAT FACE PANEL

This is a continuation of application No. 08/010,808, filed on Jan. 29, 1993, which was abandoned upon the filing hereof.

BACKGROUND OF THE INVENTION

1. Field of the Invention

The present invention relates to a cathode-ray tube having a face panel.

2. Description of the Related Art

The envelope of a cathode-ray tube generally comprises a substantially rectangular face panel having an inner surface on which a phosphor screen is formed, and a funnel coupled with the face panel by frit glass and the like. The funnel has a neck portion extending to a side opposite to the face panel, and an electron gun assembly is incorporated in the neck portion.

The outer and inner surfaces of the face panel are formed in a curved shape whose central portion projects outside such that distances between the deflection center of electron beams emitted from the electron gun assembly and a large number of scanned positions on the phosphor screen are set to be equal to each other as possible. The shape of the outer surface of the face panel is a very important factor which influences the performance of the cathode-ray tube itself and the visual impression of the cathode-ray tube.

In recent years, as a method of expressing the shape of the outer surface of a face panel, the following method is often used. That is, by using orthogonal coordinates which uses as the origin O, the center of the outer surface of the face panel, as an X-axis, a horizontal axis passing through the origin O and perpendicular to a central axis (Z-axis) of the envelope, and as a Y-axis, a vertical axis passing through the origin O and perpendicular to the Z-axis are used, and a decent amount z of an arbitrary point (x,y,z) on the outer surface is given by the following polynomial:

$$Z=\sum_{i=0}^{n}\sum_{j=0}^{n} a_{ij}x^{2i}y^{2j}$$

where i, j and n are integers of zero or more, and $a_{ij}$ are predetermined coefficients.

When the shape of the outer surface of the face panel is to be defined by the above polynomial, setting of four coefficients $a_{10}$, $a_{20}$, $a_{01}$, and $a_{02}$ of the coefficients $a_{ij}$ is most important. The coefficients $a_{10}$ and $a_{20}$ are coefficients for determining a curved shape along an x-axis (horizontal direction) of the outer surface of the panel, and the coefficients $a_{01}$ and $a_{02}$ are coefficients for determining a curved shape along a y-axis (vertical direction) of the outer surface of the panel. The substantially entire curved surface of the outer surface of the face panel is determined by the above four coefficients.

When the above four coefficients are improperly set, the following problem is posed. That is, when external light, e.g., light from fluorescent lamps in a room, is reflected on the outer surface of the face panel, the shape of the reflected external light image is unnaturally distorted, and the distorted image makes a user feel visually uncomfortable. In a conventional technique, in order to prevent external light from being reflected on the face panel, a special chemical treatment is performed to the outer surface of the face panel to cause the outer surface to be rough. The above surface treatment degrades the basic performance of a cathode-ray tube, e.g., resolution, and the manufacturing cost of the cathode-ray tube is increased by increasing the number of the steps in manufacturing the cathode-ray tube.

SUMMARY OF THE INVENTION

The present invention has been contrived in consideration of the above circumstances, and its object is to provide a cathode-ray tube wherein even when external light is reflected on the outer surface of a face panel, the external light image is natural and does not make a user feel visually uncomfortable.

In order to achieve the above object, in a cathode-ray tube according to the present invention, the shape of the outer surface of a face panel is suitable for preventing the distortion of an external light image reflected on the outer surface.

That is, according to the present invention, a cathode-ray tube comprises a substantially rectangular face panel having an outer surface and an inner surface on which a phosphor screen is formed, wherein the shape of the outer surface of the face panel is defined by using orthogonal coordinates which uses, as an origin O, the center of the outer surface of the face panel, as an X-axis, a horizontal axis passing through the origin O and perpendicular to a central axis (Z-axis) of the funnel and having, and as a Y-axis, a vertical axis passing through the origin O and perpendicular to the Z-axis, and by giving the value of z of an arbitrary point (x,y,z) on the outer surface by means of the following polynomial:

$$Z=\sum_{i=0}^{n}\sum_{j=0}^{n} a_{ij}x^{2i}y^{2j}$$

where i and j are integers of zero or more, $a_{ij}$ are predetermined coefficients, and n=2.

When coefficients for determining the surface shape of the outer surface of the face panel along the horizontal-axis are represented by $a_{10}$ and $a_{20}$, and coefficients for determining the surface shape along the vertical-axis are represented by $a_{01}$ and $a_{02}$, the coefficients $a_{10}$, $a_{20}$, $a_{01}$, and $a_{02}$ are set to satisfy the following relationships:

$$a_{20}/a_{10}<0.1\times10^{-6},\ a_{02}/a_{01}<0.1\times10^{-6}$$

As described above, a ratio of the quadratic coefficient $a_{20}$ to the quartic coefficient $a_{10}$ of the outer surface of the panel along the horizontal axis and a ratio of the quadratic coefficient $a_{02}$ to a quartic coefficient $a_{01}$ of the outer surface of the panel along the vertical axis are set to be smaller than $0.1\times10^{-6}$, so that an abrupt change in curved surface depending on the quartic coefficients with respect to the horizontal and vertical axes, which determine the substantially entire shape of the curved surface, is suppressed. Therefore, the pattern of external light image reflected on the outer surface of the panel is free from distortion, and a natural and mirror-like pattern free from discomfort can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 3 show a cathode-ray tube according to an embodiment of the present invention, in which:

FIG. 1 is a perspective view schematically showing the cathode-ray tube,

FIG. 2 is a longitudinal sectional view of the cathode-ray tube, and

FIG. 3 is a front view showing a face panel on which a lattice-like external light image is reflected.

DETAILED DESCRIPTION OF THE PREFERRED EMBODIMENT

An embodiment of the present invention will be described below in detail with reference to the accompanying drawings.

Figure 1:
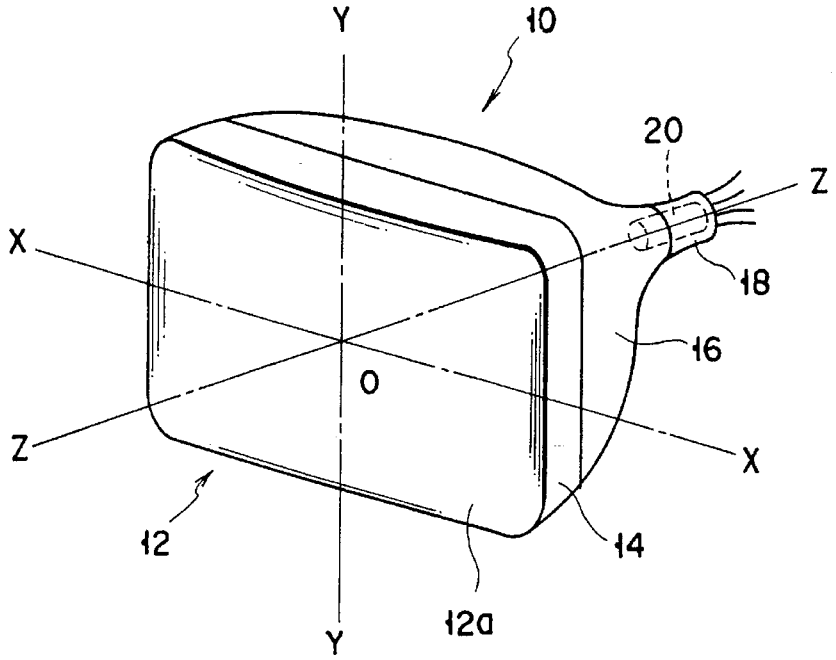
Figure 2:
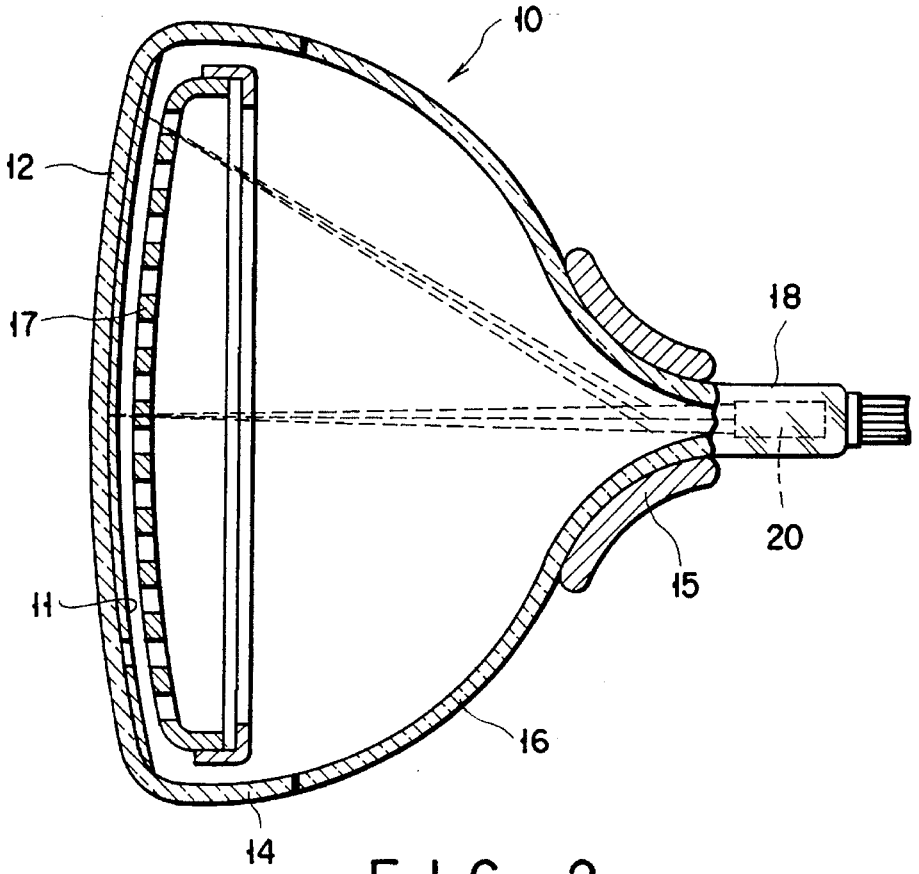

As shown in FIGS. 1 and 2, a cathode-ray tube according to this embodiment comprises an envelope 10. The envelope 10 includes a substantially rectangular face panel 12 formed of glass, and a funnel 16 coupled with a skirt portion 14 of the face panel by frit glass or the like. The face panel 12 has an inner surface on which a phosphor screen 11 is formed. The funnel 16 has a neck portion 18 extending to a side opposite to the face panel 12, and an electron gun assembly 20 is incorporated in the neck portion 18.

In the envelope 10, a shadow mask 17 is arranged opposite to the phosphor screen 11. A deflection yoke 15 is arranged around the neck portion 18. Electron beams emitted from the electron gun assembly 20 are deflected by the deflection yoke 15 and landed on the phosphor screen 11 through the shadow mask 17.

An outer surface **12*a* of the face panel 12** is formed in a curved shape to be described as follows.

Specifically, the shape of the outer surface **12*a* of the face panel 12 is defined by using orthogonal coordinates which uses as the origin O, the center of the outer surface of the face panel, as an X-axis, a horizontal axis passing through the origin O and perpendicular to a central axis (Z-axis) of the envelope 10, and as a Y-axis, a vertical axis passing through the origin O and perpendicular to the Z-axis are used, and by giving the value of z of an arbitrary point (x,y,z) on the outer surface 12*a***, i.e., a distance (descent amount) from a plane including the X- and Y-axes to the arbitrary point, by means of the following polynomial (1):

$$Z=\sum_{i=0}^{n}\sum_{j=0}^{n} a_{ij}x^{2i}y^{2j} \quad (1)$$

where i and j are integers of zero or more, $a_{ij}$ is predetermined coefficients, and n is an integer that is less than or equal to 2.

In this embodiment, of the coefficients $a_{ij}$ in polynomial (1), coefficients $a_{10}$ and $a_{20}$ respectively representing quadratic and quartic components of the outer surface of the panel along the X-axis and coefficients $a_{01}$ and $a_{02}$ respectively representing quadratic and quartic components of the outer surface of the panel along the Y-axis are set as indicated by panel A of Table 1.

TABLE 1

| | Panel (A) | Panel (B) | Panel (C) |
|---|---|---|---|
| $a_{10}$ | $2.011 \times 10^{-4}$ | $2.260 \times 10^{-4}$ | $2.092 \times 10^{4}$ |
| $a_{20}$ | $9.769 \times 10^{-12}$ | $1.025 \times 10^{-9}$ | $7.154 \times 10^{-10}$ |
| $a_{20}/a_{10}$ | $0.05 \times 10^{-6}$ | $4.54 \times 10^{-6}$ | $3.42 \times 10^{-6}$ |
| $a_{01}$ | $2.000 \times 10^{-4}$ | $2.811 \times 10^{-4}$ | $2.973 \times 10^{-4}$ |
| $a_{02}$ | $8.041 \times 10^{-12}$ | $2.207 \times 10^{-11}$ | $1.807 \times 10^{-9}$ |
| $a_{02}/a_{01}$ | $0.04 \times 10^{-6}$ | $0.08 \times 10^{-6}$ | $6.08 \times 10^{-6}$ |

That is, the coefficients are set as $a_{10}=2.001\times10^{-4}$ $a_{20}=9.769\times10^{-12}$, $a_{01}=2.000\times10^{-4}$, and $a_{02}=8.041\times10^{-12}$. The ratio $a_{20}/a_{10}$ of the quadratic coefficient to the quartic coefficient of the outer surface along the horizontal axis x is set as $a_{20}/a_{10}=0.05\times10^{-6}$, and the ratio $a_{02}/a_{01}$ of the quadratic coefficient to the quartic coefficient of the outer surface along the vertical axis Y is set as $a_{02}/a_{01}=0.04\times10^{-6}$. Either ratio is smaller than $0.1\times10^{-6}$. Specifically, according to this embodiment, the coefficients $a_{10}$, $a_{20}$, $a_{01}$, and $a_{02}$ are set to satisfy the following relationships:

$$a_{20}/a_{10}<0.1\times10^{-6},\ a_{02}/a_{01}<0.1\times10^{-6}$$

The present inventors prepared other face panels B and C respectively having different outer surface shapes to perform a test for comparing the face panels B and C with the face panel A having the outer surface which was formed to satisfy the above relationships.

Coefficients $a_{10}$, $a_{20}$, $a_{01}$, and $a_{02}$ for defining the outer surfaces of the panel B and C are set as shown in Table 1.

In the panel B, a ratio of coefficients for the vertical axis Y, as in the panel A, is set as $a_{02}/a_{01}<0.1\times10^{-6}$, but a ratio of coefficients for the horizontal axis X is set as $a_{20}/a_{10}=4.54\times10^{-6}>0.1\times10^{-6}$.

In the panel C, ratios of coefficients for the horizontal axis X and the vertical axis Y are set as $a_{20}/a_{10}=3.42\times10^{-6}$ and $a_{02}/a_{01}=6.08\times10^{-6}$, respectively. Either ratio is considerably larger than $0.1\times10^{-6}$, and especially, the ratio of each quartic component is set to be higher than that of this embodiment.

When the face panels A, B, and C were used, and light sources, e.g., fluorescent lamps, arranged in the form of a lattice at equal intervals were placed in front of each of the panels with a predetermined distance, the shapes of light source images reflected on the outer surfaces of the panels were observed, and the distortions of the light source images caused by the shapes of the outer surfaces of the panels were compared with each other.

Figure 3:
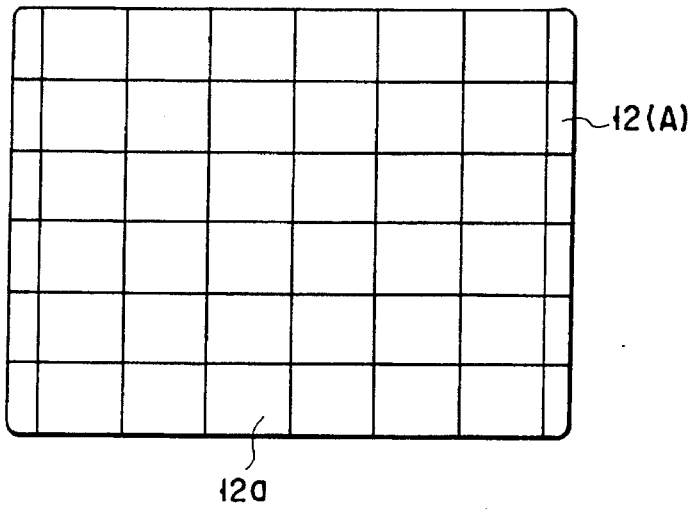
Figure 4:
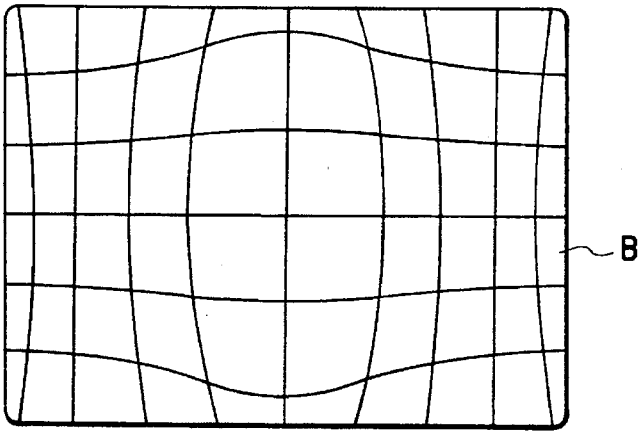
FIGS. 4 and 5 are front views showing another face panels, respectively having different curved surface shapes, on which lattice-like external light images are reflected.
Figure 5:
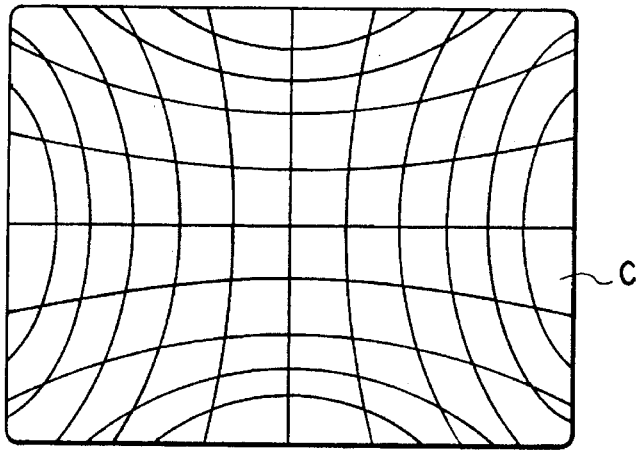

FIGS. 3 to 5 show the light source images reflected on the outer surfaces of the face panels A, B, and C, respectively. As is apparent from FIGS. 3 to 5, the light source image reflected on the panel A according to this embodiment has substantially equal lattice intervals on the horizontal and vertical axes X and Y, and a natural image having little distortion as a whole can be obtained.

In contrast to this, in the panel B in which the ratio of coefficients $a_{20}/a_{10}$ for the horizontal axis x is larger than $0.1\times10^{-6}$, the light source image reflected on the outer surface has a lattice in which the lattice intervals at the central portion of the outer surface are larger than those of the edge portions at the outer surface in the X-axis direction.

In the panel C in which each of the ratios of coefficients $a_{20}/a_{10}$ and $a_{02}/a_{01}$ for the horizontal and vertical axes X and Y is larger than $0.1\times10^{-6}$, the light image reflected on the outer surface has a lattice in which the lattice intervals at the central portion of the outer surface are larger than those of the edge portion at the outer surface in both the horizontal and vertical axes X and Y.

Therefore, in the panels B and C, the light images reflected on the outer surfaces are entirely distorted and unnatural, and the distorted light images make the user feel visually uncomfortable. For this reason, when any one of ratios of coefficients $a_{20}/a_{10}$ and $a_{02}/a_{01}$ for determining the substantially entire shape of the outer surface of a face panel is improperly set, i.e., is larger than $0.1\times10^{-6}$, a natural external light image having no distortion cannot be obtained.

According to the cathode-ray tube of this embodiment having the above-mentioned arrangement, when a descent amount z of an arbitrary point on the outer surface of the face panel is given on the basis of polynomial (1) to define the shape of the outer surface of the panel, each of the ratios $a_{20}/a_{10}$ and $a_{02}/a_{01}$ of the quadratic coefficients to the quartic coefficients of the surfaces along the horizontal and vertical axes X and Y is set to be smaller than $0.1\times10^{-6}$. For this reason, the ratios of the quadratic component to the quartic component are optimal, and an external light image reflected on the outer surface of the face panel can be obtained as a natural image having no distortion. Therefore, a cathode-ray tube which does not make the user feel visually uncomfortable can be provided. In addition, the face panel need not be applied with a surface treatment for preventing reflection, inconveniences such as degradation of resolution and an increase in manufacturing cost do not occur. As a result, a cathode-ray tube having excellent performance and design can be provided, and a great industrial value can be obtained.

Although the shape of the outer surface of the face panel is determined by the coefficients of not only the portions along the horizontal and vertical axes but also coefficients of all portions on the outer surface, the shape is almost determined by the coefficients of the portions along the horizontal and vertical axes. A sextic coefficient and coefficients of higher degrees are coefficients used for making fine adjustments of the outer surface of the face panel. Even when those coefficients are zero, problems with the cathode-ray tube are not observed. Therefore, when the coefficients $a_{10}$, $a_{20}$, $a_{01}$, and $a_{02}$ are set to satisfy the above-mentioned relationships, the above described advantages can be obtained.

The present invention is not limited to the above-described embodiment, and various changes and modifications can be effected without departing from the spirit and scope of the invention.

For example, if the coefficients $a_{10}$, $a_{20}$, $a_{01}$, and $a_{02}$ are set to satisfy the relationships: $a_{20}/a_{10}<0.1\times10^{-6}$, $a_{02}/a_{02}<0.1\times10^{-6}$, practical numerical values of the coefficients themselves can be variably changed as needed.

What is claimed is:

1. A cathode-ray tube comprising:

a face panel having a substantially rectangular outer surface and an inner surface;

a phosphor screen which is formed on the inner surface of the face panel;

a funnel coupled to said face panel; and an electron beam emitter, disposed in the funnel, constructed and arranged to emit an electron beam toward the phosphor screen;

wherein said outer surface of the face panel is defined by using orthogonal coordinates, an origin of the orthogonal coordinates being defined as a center of the outer surface of the face panel, an X-axis of the orthogonal coordinates being defined as a horizontal axis passing through the origin and perpendicular to a central axis of the funnel, and a Y-axis of the orthogonal coordinates being defined as a vertical axis passing through the origin and perpendicular to the central axis of the funnel, and a Z-axis of the orthogonal coordinates being defined as the central axis of the funnel;

wherein a Z coordinate for points on the outer surface of the face panel are defined by the following polynomial:

$$Z=\sum_{i=0}^{n}\sum_{j=0}^{n} a_{ij}x^{2i}y^{2j};$$

wherein i and j are integers $\geqq 0$, n=2, and aij are predetermined coefficients of the polynomial;

wherein the predetermined coefficients for determining a surface shape of the outer surface of the face panel along the X-axis are represented by $a_{10}$ and $a_{20}$, and coefficients for determining a surface shape of the outer surface along the Y-axis are represented by $a_{01}$ and $a_{02}$;

wherein the coefficients $a_{10}$, $a_{20}$, $a_{01}$, and $a_{02}$ satisfy the following relationships:

$a_{20}/a_{10}<0.1\times10^{-6}$, and $a_{02}/a_{01}<0.1\times10^{-6}$; and wherein the remaining coefficients are selected so that an external light image is not distorted when reflected from said outer surface of said face panel.

* * * * *